US006857140B1

(12) United States Patent
Broudy

(10) Patent No.: US 6,857,140 B1
(45) Date of Patent: Feb. 22, 2005

(54) DEVICE FOR INCREASING THE SHOWER SPACE IN A BATHTUB

(76) Inventor: Jon Broudy, 1148 Treefern Dr., Virginia Beach, VA (US) 23451-6603

( * ) Notice: Subject to any disclaimer, the term of this patent is extended or adjusted under 35 U.S.C. 154(b) by 0 days.

(21) Appl. No.: 10/679,344

(22) Filed: Oct. 7, 2003

(51) Int. Cl.[7] ..... A47K 3/20

(52) U.S. Cl. ..... 4/609; 4/558; 160/349.1; 160/DIG. 6

(58) Field of Search ..... 4/609, 610, 605, 4/608, 558; 160/349.1, 330, DIG. 6

(56) References Cited

U.S. PATENT DOCUMENTS

| | | | | | |
|---|---|---|---|---|---|
| 1,255,396 | A | | 2/1918 | Eaton | |
| 1,971,802 | A | * | 8/1934 | Zechiel | 4/609 |
| 2,032,180 | A | | 2/1936 | McCord | |
| 2,776,439 | A | | 1/1957 | Rondinelli | |
| 3,808,610 | A | | 5/1974 | Mortensen | |
| 3,934,636 | A | * | 1/1976 | Simmons | 160/349.1 |
| 4,888,835 | A | * | 12/1989 | Baumann | 4/609 |
| 5,007,120 | A | | 4/1991 | Annand | |
| 5,243,715 | A | * | 9/1993 | Barmak | 4/558 |
| 5,345,623 | A | | 9/1994 | Dearman | |
| 5,365,619 | A | * | 11/1994 | Solomon | 4/609 |
| 5,771,504 | A | | 6/1998 | Steiner | |

* cited by examiner

*Primary Examiner*—Gregory L. Huson
*Assistant Examiner*—Kathleen J. Prunner
(74) *Attorney, Agent, or Firm*—Stites & Harbison, PLLC; Ross F. Hunt, Jr.

(57) ABSTRACT

A space expanding device is provided for temporarily expanding the available space defined by a shower curtain within a shower area of a bathtub. The device includes a first elongate planar portion which, in use, rests on an upper surface of the side wall of the bathtub. A second elongate planar portion affixed to one edge of the first portion extends, in use, downwardly from the first portion adjacent an inner side surface of the side wall. A third elongate planar portion affixed to the opposite edge of the first portion extends, in use, upwardly from the first portion away from the upper surface of the side wall. In use of the device, the third portion holds a portion of the shower curtain in a position spaced away from the interior of the bathtub, while a lower portion of the shower curtain is captured between the first portion of the member and the upper surface of the side wall of the bathtub and between the second portion of the member and the inner side surface of the side wall.

15 Claims, 4 Drawing Sheets

DEVICE FOR INCREASING THE SHOWER SPACE IN A BATHTUB

FIELD OF THE INVENTION

The present invention relates to bathtub-shower combinations wherein a bather stands in the bathtub to take a shower and a shower curtain is used to keep the shower water in the bathtub shower area, i.e., to prevent the shower water from falling or splashing onto the floor.

BACKGROUND OF THE INVENTION

In a bathtub-shower combination such as described above wherein a shower curtain is used to control splashing or other deflection of the shower water out of the shower space, the shower curtain, which is usually suspended from a rod which is located above and extends parallel to the side wall of the bathtub, is drawn in or tucked in at the bottom so that a bottom portion thereof is inside the side wall of the bathtub so as to prevent water from splashing out of the shower space beneath the lower edge of the shower curtain between the side wall and this lower edge. Although this is generally effective, there are disadvantages. For example, with the lower portion of the shower curtain disposed inside the bathtub, the available shower space is reduced. This results in something of a claustrophobic effect for some bathers while, more generally, most bathers prefer to have as much arm and leg room as possible. Another problem is that in the position described, the lower edge of the shower curtain can be blown in (e.g., by a draft) and among other consequences, this also reduces the shower space particularly with respect to leg room.

Patents of interest in the general field of shower accessories include the following U.S. Pat. No. : 5,771,504 to Steiner; 5,345,623 to Dearman; 5,345,624 to Brown III 5,031,257 to Jeffrey; 5,007,120 to Annand; 4,229,842 to Gilmore; 4,754,504 to Cellini; 3,872,520 to Tyconik; 3,808,610 to Mortensen; 2,776,439 to Rondinelli; 2,032,180 to McCord and 1,255,396 to Eaton.

Briefly considering some of these patents, the Steiner patent discloses an apparatus for use with a bathtub shower curtain which prevents the curtain from being drawn into the shower enclosure when the shower is in use. The apparatus includes a plurality of vertically oriented semi-rigid ribs. Each rib includes an upper end which is connected to a shower curtain rod and a lower end which is secured to the edge of a bathtub.

The Mortensen patent discloses a shower curtain guard for use particularly in connection with shower enclosures above conventional bathtubs. The guard comprises a vertical bar or rail attached, by a double adhesive medium, to a wall at one or both ends of the bathtub. The rail is bent inwardly above the tub to hold the lower end of the curtain within the tub while affording a wider shower compartment above the tub.

The Dearman patent discloses an apparatus for deflecting a shower curtain away from a shower stall. The apparatus comprises slidable rods accommodated in a tube which, when bowed, resists relative sliding movement of the rods. The opposite ends of the bowed deflector bear against spaced walls of the shower stall and cause the shower curtain also to be bowed outwardly so as to increase the usable space within the shower stall.

The Annand patent discloses a device which holds a shower curtain away from a user of a shower. The device includes a downwardly extending section including a top end attached to a mounting section which is supported on a curtain rod. The downwardly extending section also includes a curtain engaging lower end.

The Rondinelli patent discloses a shower bath curtain arrangement including a curtain support device which fits on the tub and is comprised of two angled arms which hold the curtain away from the tub.

The McCord patent discloses a shower shield including a portion which fits on the edge of the tub.

The Eaton patent discloses a bath curtain including a portion which fits on the tub.

The other patents generally show various methods and/or devices for deflecting a shower curtain, or a portion thereof, away from a shower stall.

SUMMARY OF THE INVENTION

In accordance with the invention, there is provided a device for temporarily increasing or expanding the shower space in a bathtub shower by deflecting a portion of a shower curtain outwardly and away from the bathtub area, i.e., in a direction which increases the shower space. An important feature of the invention is the simplicity thereof and, with respect to this feature, in a preferred implementation thereof, the device of the invention is of a simple one-piece construction which is extremely easy to install for use for its intended purpose. In the latter regard, it has been found that the device of the invention can be installed for operation in about four seconds. It will be appreciated that the simplicity of the invention and the ease of installation thereof are important advantages over the relatively complex prior art devices discussed above. Further, in an important embodiment, the device is collapsible, i.e., foldable to a compact, easy to store configuration. This is also an important advantage over the relatively bulky, space consuming devices of the prior art.

In accordance with a first aspect of the invention, there is provided a device for temporarily expanding available space defined by a shower curtain within a shower area of a bathtub including a side wall, the device comprising:

a space expanding member including a first elongate planar portion for, in use, resting on an upper surface of the side wall of the bathtub, a second elongate planar portion affixed to one edge of said first portion for, in use, extending downwardly from said first portion adjacent an inner side surface of the side wall and a third elongate planar portion affixed to an opposite edge of said first portion for, in use, extending upwardly from said first portion away from the upper surface of the side wall so that, in use, the third portion holds a portion of the shower curtain in a position spaced away from the interior of the bathtub, with a lower portion of the shower curtain being captured between the first portion of the member and the upper surface of the side wall of the bathtub and between the second portion of the member and said inner side surface of the side wall of the bathtub.

Preferably, the first, second and third planar portions of the member are collapsible together to form a substantially flat configuration.

The second and third planar portions of said member are preferably pivotably connected to the first member so as to be movable relative thereto.

In an alternative embodiment, the member is of a rigid one piece construction.

Preferably, the third portion, in use, forms an obtuse angle with said first portion.

Advantageously, the first portion includes a non-skid surface which, in use, faces the portion of the shower curtain captured thereunder.

In an advantageous implementation, the member is comprised of an acrylic plastic.

Preferably, the first member is adapted to act as a shelf in use.

Advantageously, the first portion includes at least one cup holder. In one embodiment, the at least one cup holder has a longitudinal axis extending perpendicularly to said first portion. In an alternative embodiment, the at least one cup extends at a slant angle with respect to said first portion.

In another preferred implementation, the space expanding member comprises first and second sections, said first section being adapted to be affixed to the side of the bathtub and the sections being connected together along a transverse fold line so that said second section can be folded up toward the first section when the first section is affixed to the side wall. Preferably, the first portion of the first section is adapted to be affixed to the side wall of the bathtub.

According to a second aspect of the invention, there is provided a method for temporarily expanding available space defined by a shower curtain within a bathtub including a side wall, said method comprising:

providing a space expanding member comprising a first intermediate portion having first and second lateral edges, and second and third portions extending outwardly in opposite directions from respective ones of said lateral edges of said first portion;

lifting the shower curtain so as to provide slack therein;

placing the space expanding member on the side wall of the bathtub such that a lower portion of the shower curtain is captured beneath the member; and adjusting the member, as necessary, such that the first portion of said member rests on an upper surface of the side wall and said second portion is disposed adjacent an inner side surface of the side wall, with parts of the lower portion of the shower curtain being disposed between the first and second portions of the space expanding member and the upper surface and inner side surface of the side wall, respectively, and with the third portion of the member holding a further part of the shower curtain away from the interior of the bathtub so as to create an expanded shower space above the side wall of the bathtub portion, and the first portion creating a shelf for shower items.

Further features and advantages of the present invention will be set forth in, or apparent from, the detailed description of preferred embodiments thereof which follows.

DESCRIPTION OF THE PREFERRED EMBODIMENTS

Figure 1:
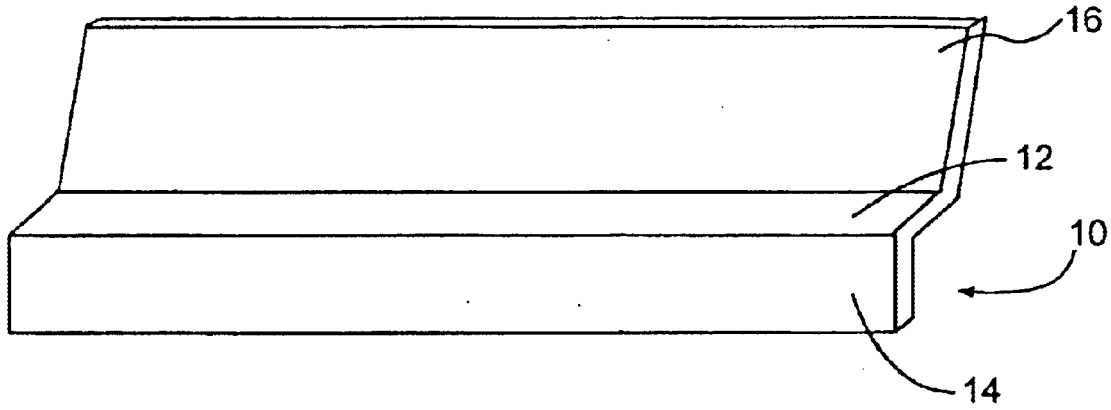
FIG. 1 is a perspective view of a shower space widener or expander device in accordance with one preferred embodiment of the invention.

Referring to FIG. 1, there is shown a shower space expander or widener device in accordance with a first embodiment of the invention. Although the device, which is generally denoted 10, is preferably of a collapsible or fold-down construction as shown in FIG. 2, the device may also be of a rigid one-piece construction a shown in FIG. 1.

Device 10 includes a first, elongate, planar, intermediate portion 12, a second, elongate, planar, end portion 14 extending outwardly in one direction from one lateral edge of portion 12, and a third, elongate, planar, end portion 16 extending outwardly in the opposite direction from the opposite lateral edge of first portion 12.

Figure 2:
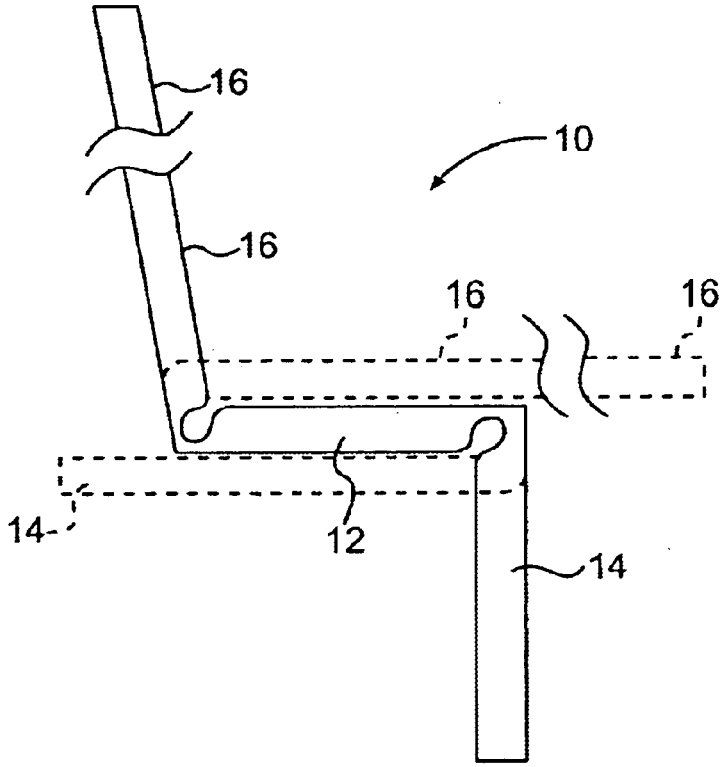
FIG. 2 is an end elevational view of a further embodiment of the device of the invention, showing the device in a collapsed or folded-up state in dashed lines.

Referring to FIG. 2, wherein corresponding elements have been given the same reference numerals as in FIG. 1, in this embodiment, as indicated above, the portions 12, 14 and 16 are collapsible on one another or, more specifically, as shown in dashed lines, end portions 14 and 16 are capable of being folded onto central or immediate portion 12 so that the device 10 assumes a compact, easy to store shape or configuration. This capability of folding or pivoting of portions 14 and 16 can be provided in a number of different ways and, in this regard, member 10 can be made of a bendable material such as a bendable plastic and is, in the specific embodiment illustrated, the areas of connection 12*a* and 12*b* between portion 12 and portions 14 and 16 may be of reduced thickness so as to form hinge at these areas. (A so-called "living hinge" (not shown) can instead be built into the connecting areas 12*a* and 12*b*.) Alternatively, three separate members corresponding to portions 12, 14 and 16 may be connected together by tape, hinges or the like to enable the pivoting action described above.

As indicated at 12*a* in FIG. 2, the lower or under surface of portion 12 may be roughened or include a non-stick coating to improve the adhesion thereof.

Preferably, in the operative position of device 10 shown in solid lines in FIG. 2, the second portion 14 of device 10 extends orthogonally to central or middle portion 12 while the third portion 16 extends outwardly therefrom at an obtuse angle, i.e., forms an angle somewhat greater than 90°.

Figure 3:
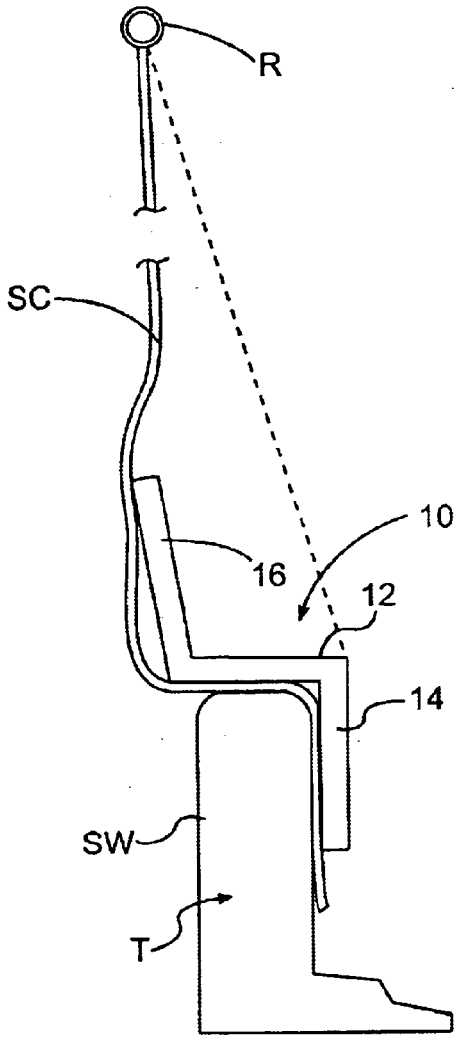
FIG. 3 is a schematic cross sectional view, partially broken away, of a portion of a shower and bathtub combination including a shower curtain, showing the device of the invention in use.

Referring to FIG. 3, the device 10 is shown in use. In FIG. 3, a shower curtain SC is supported on a curtain rod R in a conventional manner so as to hang down adjacent to the side wall SW of a bathtub, generally denoted T. Typically, when taking a shower, the bather will tuck the shower curtain SC inside the tub wall SW so that shower water does not splash onto the floor. This results in the shower curtain SC being disposed or positioned generally as indicated by dashed line A in FIG. 2, thereby decreasing the shower space available above the tub side wall SW. As discussed above, some bathers find that this reduction of the shower space produces a claustrophobic effect. More generally, most bathers would simply prefer to have more arm and leg room when taking a shower than is provided with the shower curtain SC positioned as indicated by dashed line A.

As illustrated in FIG. 3, expander or widener device 10 expands the shower space, and, as shown, the intermediate or central portion 12 of device 10 rests on the upper surface of side wall SW while the second, downwardly depending portion 14 is disposed adjacent to the inner side surface of the side wall SW of bathtub T, with the lower portion of shower curtain SW being captured between portions 12 and 14 and the respective surfaces of side wall SW. Thus, portions 12 and 14 hold the lower portion of shower curtain SC firmly in place and prevent the curtain SC from blowing in, thereby providing more leg room in the shower. The third upper or upwardly extending portion 16 engages shower curtain SC higher up, and holds shower curtain SC away from the interior of bathtub T, as shown, thus providing more arm room.

Figure 4:
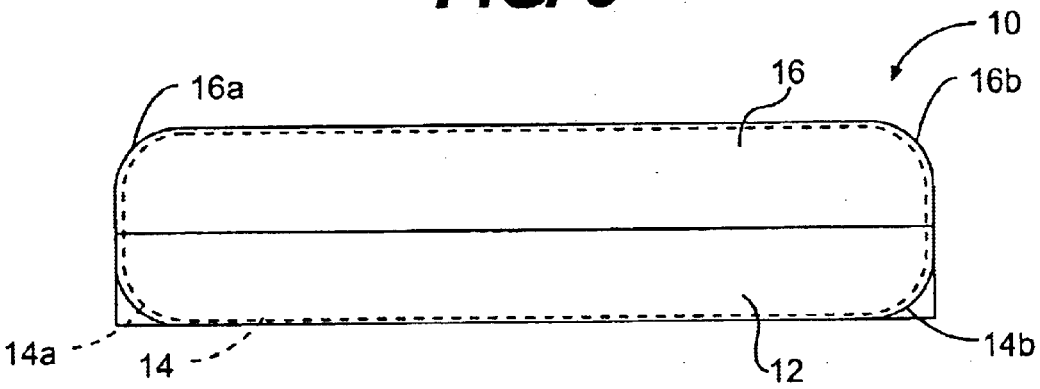
FIG. 4 is a top plan view of an alternative embodiment of the invention.

Referring to FIG. 4, which is a top plan view of an alternative embodiment of space expanding device 10, the upper right and left edges 16*a* and 16*b* of portion 16 may be curled or otherwise curved outwardly, and the lower left and right edges 14*a* and 14*b* are curled or otherwise curved inwardly to help maintain device 10 in place.

Figure 5:
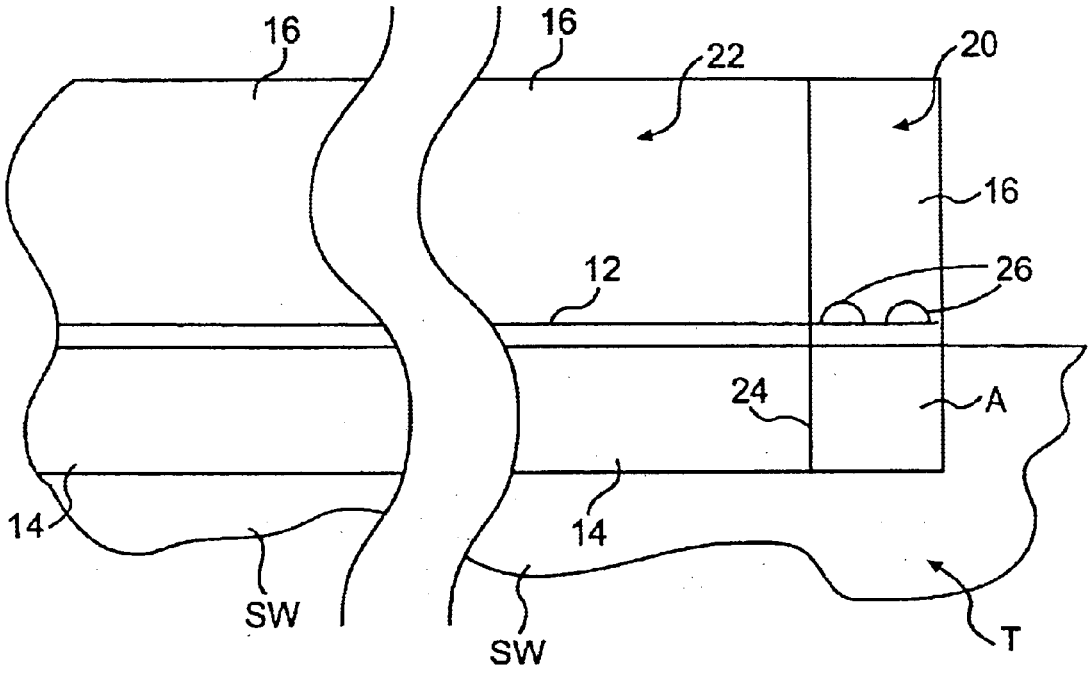
FIG. 5 is a side elevational view, partially broken away, of a further embodiment of the invention.
Figure 6:
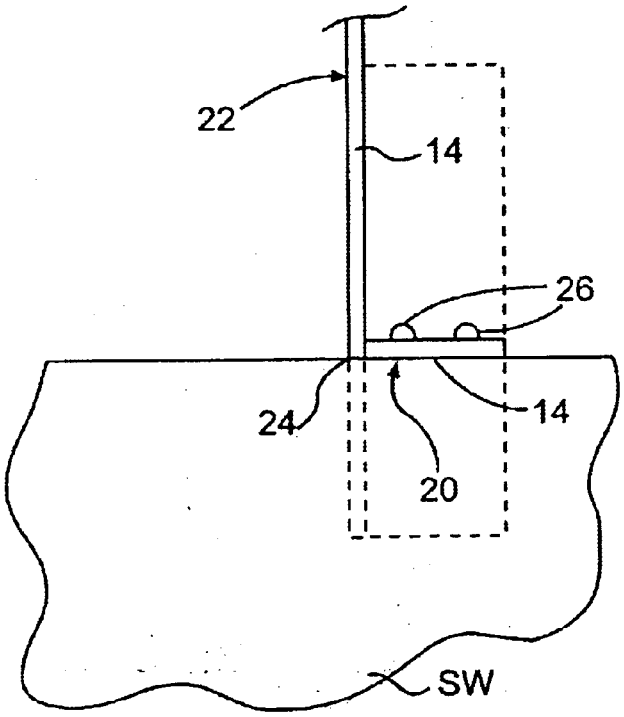
FIG. 6 is a further side elevational view of the device of FIG. 5, showing the folded up or inoperative state of the device.
Figure 7:
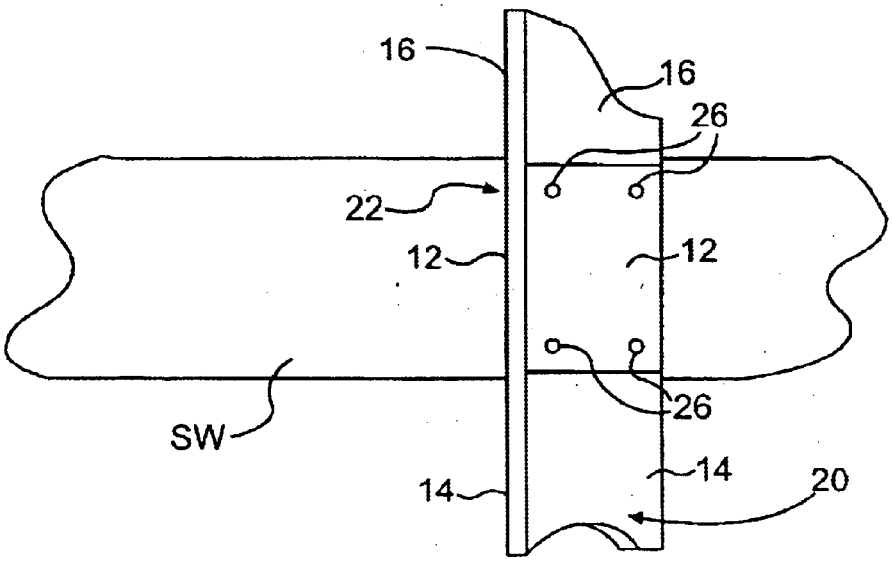
FIG. 7 is a top plan view of the device of FIG. 5, in the state shown in FIG. 6.

Referring to FIGS. 5 to 7 a further embodiment of the invention is shown. In this embodiment, a first part or section of the device, denoted 20, is bolted or otherwise affixed to the bathtub side wall SW while a second part or section, denoted 22, is hingedly or pivotedly affixed to the fixed part or section 20 along a pivot or hinge line 24. More specifically, both parts 20 and 22 are formed of three portions 12, 14 and 16, as described above in connection with device 10, and center part 12 of part 20 is bolted, by bolts 26, to, or otherwise affixed to the side wall SW of bathtub T. Part 22 is substantially longer than part 20 and as shown in FIG. 5, the two parts 20 and 22, in use, form a device similar to device 10 of FIGS. 1 and 2.

In order to lift part 22 out of the way when entering or exiting from the tub, the three portions 12, 14 and 16 of part 20 are disposed in the same horizontal plane as shown in FIGS. 6 and 7, and part 22 is folded or pivoted vertically along hinge line 24, as is also shown in these figures, thus creating an entry and exit space. This embodiment is particularly useful in commercial applications of the invention, e.g., wherein the device is installed in a hotel or motel room, in that it prevents removal of the device.

Figure 8:
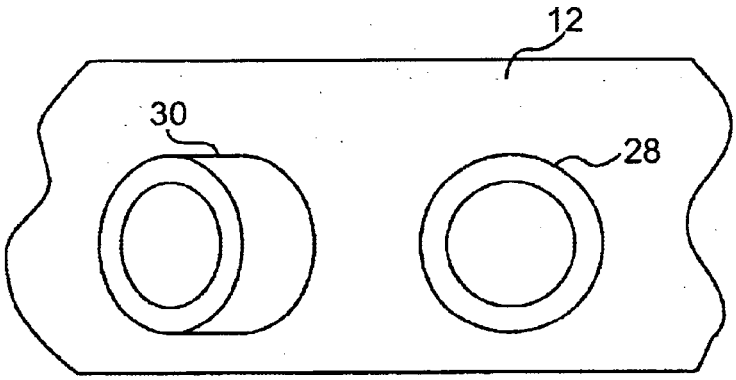
FIGS. 8 and 9 are a top plan view and a side elevation of a portion of the device of the invention, showing a further embodiment thereof.
Figure 9:
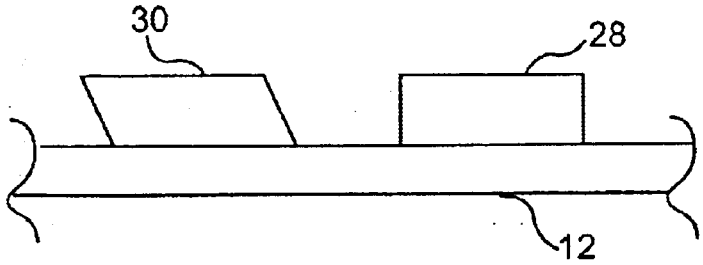

Referring to FIGS. 8 and 9, a further embodiment of the invention is shown. In this embodiment, integral cup holders 28 and 30 are provided on intermediate or central portion 12, i.e., the portion that rests, in use, on the upper surface of the side wall of the bathtub. As illustrated, the cup holders may be upright, i.e., orthogonal to portion 12, as indicated by cup 28, or may be slanted to one side, as indicated by cup 30. It will be understood that one kind of cup or the other would normally be used, and that the cup holders of this embodiment may be used in any of the embodiments described above.

Device 10 is preferably made of a mildew resistant acrylic plastic, although other materials may also be used.

Although these dimensions are exemplary and are not to be taken as limiting, in an advantageous implementation, device 10 is three feet long and ⅛ inch thick and portions 12, 14 and 16 are 2 inches in width, 3 inches in width and 9 inches in width, respectively.

Although the invention has been described above in relation to preferred embodiments thereof, it will be understood by those skilled in the art that variations and modifications can be effected in these preferred embodiments without departing from the scope and spirit of the invention.

What is claimed is:

1. A device for temporarily expanding available space defined by a shower curtain within a shower area of a bathtub including a side wall, said device comprising:

a space expanding member including a first elongate planar portion for, in use, resting on an upper surface of the side wall of the bathtub, a second elongate planar portion affixed to one edge of said first portion for, in use, extending downwardly from said first portion adjacent an inner side surface of the side wall and a third elongate planar portion affixed to an opposite edge of said first portion for, in use, extending upwardly from said first portion away from the upper surface of the side wall so that, in use, the third portion holds a portion of the shower curtain in a position spaced away from the interior of the bathtub, with a lower portion of the shower curtain being captured between the first portion of the member and the upper surface of the side wall of the bathtub and between the second portion of the member and said inner side surface of the side wall of the bathtub.

2. A device as claimed in claim 1 wherein said first, second and third planar portions of said member are collapsible together to form a substantially flat configuration.

3. A device as claimed in claim 1 wherein said second and third planar portions of said member are pivotably connected to said first member so as to be movable relative thereto.

4. A device as claimed in claim 1 wherein said third portion, in use, forms an obtuse angle with said first portion.

5. A device as claimed in claim 1 wherein said first portion includes a non-skid surface which, in use, faces the portion of the shower curtain captured thereunder.

6. A device as claimed in claim 1 wherein said member is comprised of an acrylic plastic.

7. A device as claimed in claim 1 wherein said first portion is adapted to act as a shelf, in use.

8. A device as claimed in claim 7 wherein said first portion includes at least one cup holder.

9. A device as claimed in claim 8 wherein said at least one cup holder has a longitudinal axis extending perpendicularly to said first portion.

10. A device as claimed in claim 7 wherein said at least one cup extends at a slant angle with respect to said first portion.

11. A device as claimed in claim 1 wherein said member is of a rigid one-piece construction.

12. A device as claimed in claim 1 wherein said space expanding member comprises first and second sections, said first section being adapted to be affixed to the side of the bathtub and said sections being connected together along a transverse fold line so that said second section can be folded up toward the first section when the first section is affixed to the side wall.

13. A device as claimed in claim 12 wherein said first portion of the first section is adapted to be affixed to the side wall of the bathtub.

14. A method for temporarily expanding available space defined by a shower curtain within a bathtub including a side wall, said method comprising:

providing a space expanding member comprising a first intermediate portion having first and second lateral edges, and second and third portions extending outwardly in opposite directions from respective ones of said lateral edges of said first portion in opposite direction;

lifting the shower curtain so as to provide slack therein;

placing the space expanding member on the side wall of the bathtub such that a lower portion of the shower curtain is captured beneath the member; and adjusting the space expanding member, as necessary, such that the first portion of said member rests on an upper surface of the side wall and said second portion is disposed adjacent an inner side surface of the side wall, with parts of the lower portion of the shower curtain disposed between the first and second portions of the space extending member and the upper surface and inner side surface of the side wall, respectively, and with the third portion of the member holding a further part of the shower curtain away from the interior of the bathtub so as to create an expanded shower space above the side wall of the bathtub portion, said first portion creating a shelf for shower items.

15. A device for temporarily expanding available space defined by a shower curtain within a shower area of a bathtub including a side wall, said device comprising:

a space expanding member including a first elongate planar portion for, in use, resting on an upper surface of the side wall of the bathtub, a second elongate planar portion affixed to one edge of said first portion for, in use, extending upwardly from said first portion away from the upper surface of the side wall so that, in use, the second portion holds a portion of the shower curtain in a position spaced away from the interior of the bathtub, with a lower portion of the shower curtain being captured between the first portion of the member and the upper surface of the side wall of the bathtub.

* * * * *